United States Patent [19]

Fethke et al.

[11] Patent Number: 4,495,696

[45] Date of Patent: Jan. 29, 1985

[54] SCISSORS SHEATH HAVING INTEGRAL BLADE SHARPENER

[75] Inventors: Wayne G. Fethke, Wausau; Daniel D. Call, Athens, both of Wis.

[73] Assignee: Oy Fiskars AB, Helsinki, Finland

[21] Appl. No.: 454,465

[22] Filed: Dec. 29, 1982

[51] Int. Cl.[3] ..... B26B 13/00; B24D 7/16

[52] U.S. Cl. ..... 30/138; 51/204

[58] Field of Search ..... 30/138, 139, 151; 76/82, 82.2, 86, 88; 51/205, 214, 204, 211

[56] References Cited

U.S. PATENT DOCUMENTS

| | | | |
|---|---|---|---|
| 1,051,333 | 1/1913 | Jacoby | 76/82.2 |
| 1,508,314 | 9/1924 | Williams et al. | 76/82.2 |
| 1,963,422 | 6/1934 | Scott | 76/82.2 |
| 3,676,961 | 7/1972 | Jackson | 30/138 |
| 4,041,651 | 8/1977 | Bayly | 51/204 |
| 4,348,809 | 9/1982 | Jackson | 30/138 |
| 4,414,744 | 11/1983 | Collins | 30/204 |

*Primary Examiner*—Paul A. Bell
*Assistant Examiner*—Paul M. Heyrana, Sr.
*Attorney, Agent, or Firm*—James E. Nilles; Thomas F. Kirby

[57] ABSTRACT

A plastic sheath for protecting the blades of a pair of scissors being stored or carried comprises two elongated plastic members permanently secured together along a mating seam as by sonic weld to provide a pair of spaced apart side walls and a pair of edge walls which cooperate to define an elongated blade-receiving passage open at one end and extending along the longitudinal axis of the sheath. A blade-sharpening slot extends inwardly from one edge of the sheath transversely to the sheath axis and includes outer and inner interconnected offset slot portions. An elongated abrasive blade sharpening element is stationarily mounted inside the blade passage of the sheath and extends generally longitudinally of the sheath and intersects the blade sharpening slot between offset adjacent ends of the blade sharpening slot portions. In use, the sheath is manually grasped as if it were a handle and a pair of scissors blades are simultaneously received in both slot portions and the blade edges are moved slidably and reciprocably transversely across the sharpening element to effect sharpening. The sheath includes a resilient portion integrally formed in the other edge of the sheath and having a projection which is releasably engageable with a pair of scissors inserted in the sheath to positively but releasably secure the scissors in the sheath.

7 Claims, 9 Drawing Figures

SCISSORS SHEATH HAVING INTEGRAL BLADE SHARPENER

BACKGROUND OF THE INVENTION

1. Field of Use

This invention relates generally to scissors sheaths having improved integral blade sharpening means and improved scissors dislodgement means embodied therein.

2. Description of the Prior Art

Scissors, shears and similar cutting implements having two pivotally connected cutting blades (hereinafter referred to as "scissors") are sometimes provided with a sheath which protects the scissors blades while the scissors are stored or carried therein to thereby prevent dulling of the blades, to prevent injury to a user and to prevent damage to other objects. Such sheaths are usually constructed so as to prevent accidental or unintentional dislodgement or removal of the scissors from the sheath, while enabling intentional withdrawal. For best service, it is sometimes desirable to sharpen the blades very often before use or merely from time to time as conditions require. Therefore, it is advantageous for the user to have at hand some type of scissors blade sharpening device, such as those shown, for example, in the following U.S. Pat. Nos.: 2,423,231, Elphee; 2,713,238, Stead; 4,258,592, Linden; 2,115,778, Krahenbuhl; 4,050,197, Thompson; 3,234,823, Lizak; 2,069,608, Hammond; 2,009,389, Anderson; 479,737, Collum; 1,471,136, Borleis; 1,051,333, Jacoby; 757,843 Rose. Not infrequently, through oversight or carelessness, such sharpening devices are not at hand or, being relatively small, are difficult or impossible to locate when needed, or even turn out to be lost. As a result, the scissors blades sometimes go unsharpened, the cutting work is not well done and the user is frustrated and upset. The prior art also contains examples of scissors sheaths having blade sharpening means mounted thereon or associated therewith, and the following U.S. patent illustrates the state of the art; U.S. Pat. No. 4,348,809.

SUMMARY OF THE INVENTION

In accordance with the invention there is provided an improved sheath for a pair of scissors, which sheath is provided with improved blade sharpening means embodied therein or permanently mounted thereon and with improved latch means for preventing dislodgement or unintentional removal of the scissors from the sheath embodied therein.

The sheath, which is fabricated of rigid material such as plastic or the like, for example, comprises two elongated molded plastic component members which are permanently secured together along a mating peripheral edge seam as by sonic welding to provide a pair of spaced apart side walls and a pair of edge walls which cooperate to define an elongated blade-receiving passage open at one end and extending along the longitudinal axis of the sheath for accommodating and protecting the blades of a scissors carried in the sheath.

The blade sharpening means generally comprise a blade-sharpening slot formed in and extending inwardly from one edge of the sheath transversely to the sheath axis and includes outer and inner interconnected offset slot portions. An elongated abrasive blade sharpening element is stationarily mounted inside the blade passage of the sheath and intersects the sharpening slot between the offset adjacent ends of the slot portions for making sliding engagement with the cutting edges of the scissors blades being reciprocably moved in the sharpening slot portions to effect blade sharpening. The blades in the sharpening slot move along an axis which is transverse to the longitudinal axis of the elongated passage in the sheath. The blade sharpening element is fabricated of material hard enough to sharpen the edge of a scissors blade, such as abrasive stone or even tool steel, but preferably comprises a single abrasive cylindrical ceramic rod which extends at a slight intersecting angle relative to the aforesaid longitudinal passage axis in the sheath. The sharpening element is entrapped in a recess defined by bracket members integrally formed in the inner surfaces of the pair of components forming the sheath. The sharpening slot portions are constructed and shaped so as to support the scissors blades in optimum desired during sharpening. The abrasive element is disposed diagonally crosswise in the slot between the inner and outer slot portions. The outer slot portion is open at its outer end and closed at its other end by the abrasive element. The inner slot portion is closed at one end by the abrasive element and is closed at its other end by the sheath wall structure. In operation, one of the scissors blades is inserted into the inner portion of the sharpening slot, the other blade into the outer portion, and then both blades are moved reciprocably therein at an appropriate angle with the blade edges to be sharpened in engagement with opposite sides of the abrasive element so that the blade edges bear or wipe against the blade sharpening abrasive element. Such movement is repeated until the desired degree of sharpness is attained.

The means for preventing dislodgement or unintentional removal of the scissors from the sheath comprise a resilient elongated latch member which is integrally connected at one of its ends to one of the edge walls defined by one of the components defining the sheath. The other end of the resilient elongated latch member is provided with an abutment or latch projection which extends into the passage in the sheath. Insertion of the closed scissors blades through the end opening and into the passage in the sheath causes engagement of the blades with the projection and the latch member to bias outwardly to allow blade insertion until the blades are fully inserted, whereupon the latch member returns inwardly and the latch projection engages a portion of the scissors. Such engagement prevents withdrawal of the scissors from the sheath unless sufficient force is exerted to cause displacement of the resilient latch member.

A scissors sheath having blade sharpening means mounted thereon or integral therewith in accordance with the invention offers several advantages over the prior art. For example, since the blade sharpening means are, in effect, an integral part of the sheath, the blade sharpening means are always at hand when needed and cannot be lost or displaced. The arrangement eliminates the need for a separate storage compartment or support for the blade sharpening means. The sheath also serves as a convenient, safe and easily held holder for the blade sharpening means thereon when a scissors is being sharpened. The location, configuration, arrangement and construction of the sharpening slot and the associated blade sharpening abrasive means ensure that the blades assume the correct angular position relative to the abrasive means as the blades are moved or drawn through a sharpening stroke.

Provision on the sheath of a latch means which includes a resilient portion integrally formed in the other edge of the sheath and having a projection which is releasably engageable with a pair of scissors inserted in the sheath to positively but releasably secure the scissors in the sheath, prevents accidental withdrawal of the scissors. Integral formation of such latch means with the sheath is economical and eliminates the need for separate parts.

Other objects and advantages of the invention will hereinafter appear.

DRAWINGS

DESCRIPTION OF A PREFERRED EMBODIMENT

Figure 1:
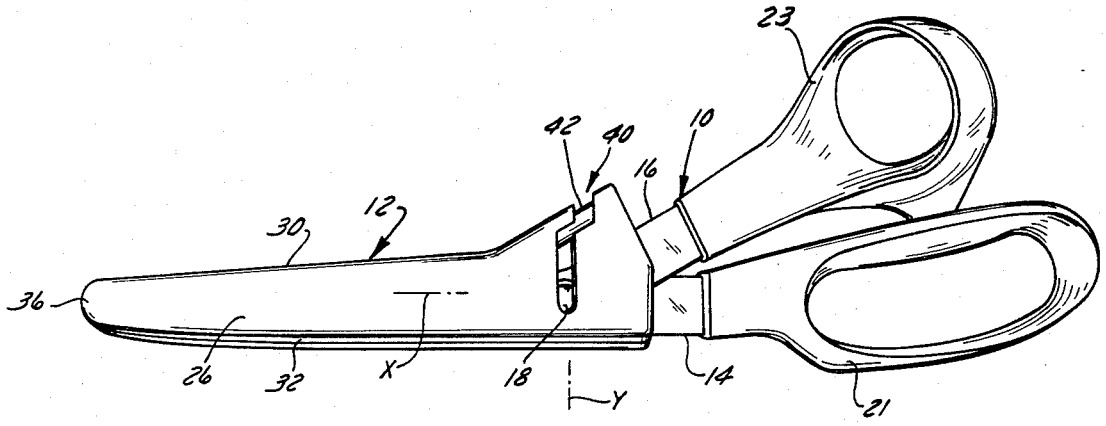
FIG. 1 is a side elevation view of a sheath in accordance with the invention and showing a pair of scissors inserted therein.
Figure 2:
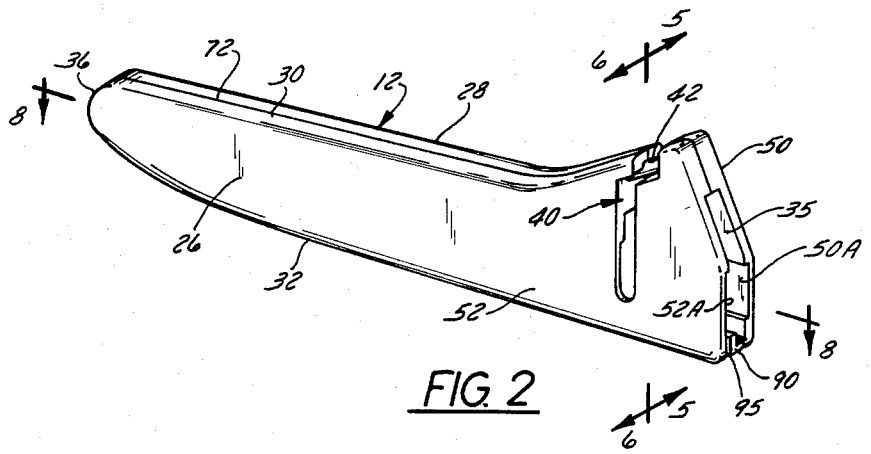
FIG. 2 is an enlarged perspective view of the sheath of FIG. 1 with scissors removed and showing one side, one edge and the open end thereof.
Figure 3:
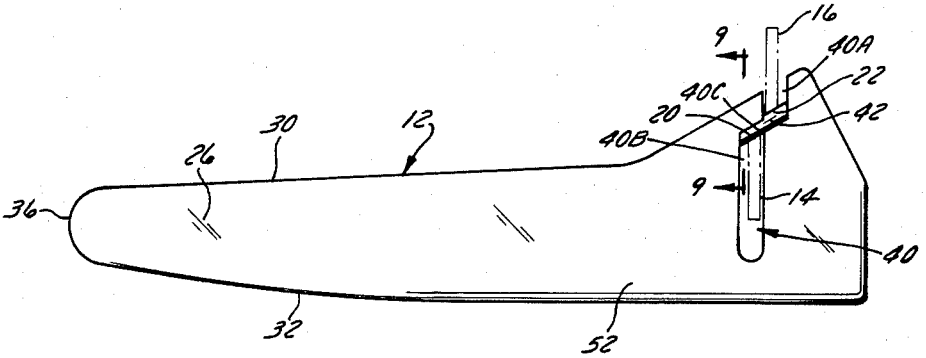
FIG. 3 is a side elevation view of the sheath of FIGS. 1 and 2.
Figure 4:
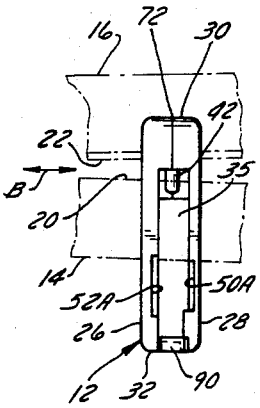
FIG. 4 is an end view of the open end of the sheath of FIG. 3.
Figure 5:
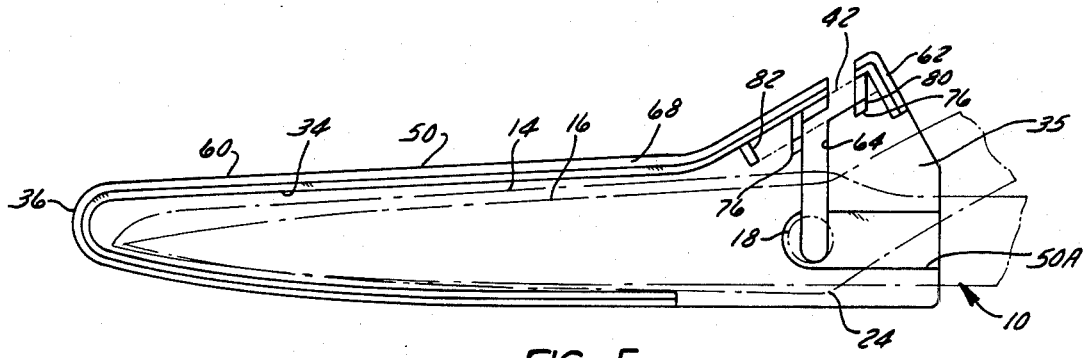
FIG. 5 is a side elevation view taken on line 5—5 of FIG. 2 of the inside surface of one of a pair of molded components of which the sheath is formed and showing in phantom disposition of the scissors of FIG. 1 thereon.
Figure 6:
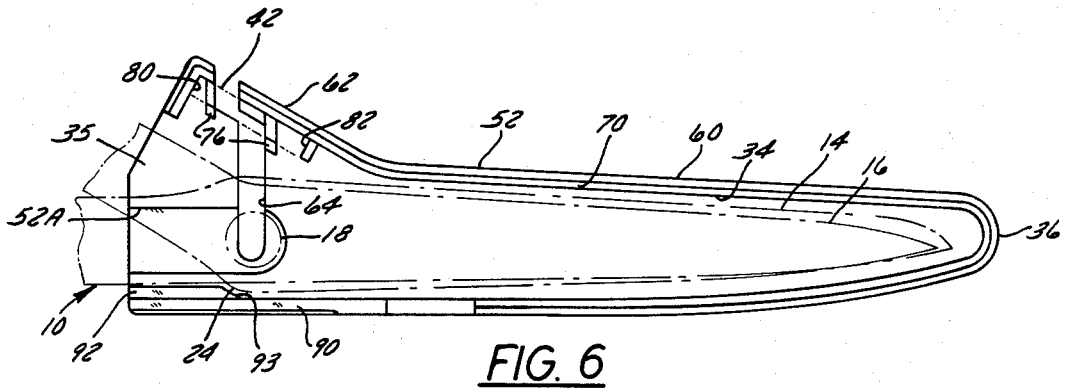
FIG. 6 is a view similar of FIG. 5 but taken on line 6—6 of FIG. 2 and showing the other of the pair of molded components of the sheath.
Figure 7:
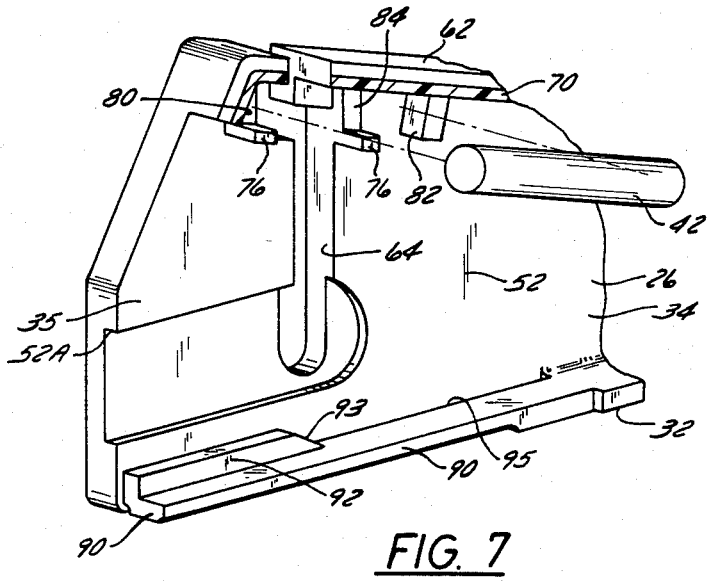
FIG. 7 is an enlarged exploded perspective view of the inside of the left end of the molded sheath component shown in FIG. 6 and showing an elongated cylindrical ceramic element associated therewith.

Referring to FIGS. 1, 3, 4, 5 and 6, the numeral 10 designates a pair of scissors which are shown in association with a sheath 12 in accordance with the present invention. FIGS. 1, 5 and 6 show scissors 10 in storage position within sheath 12. FIGS. 3 and 4 show scissors 10 in sharpening position within sheath 12. Scissors 10 comprises a pair of blades 14 and 16 which are pivotally connected together by a pivot pin 18. Blade 14 includes a cutting edge 20 and a handle 21. Blade 16 includes a cutting edge 22 and a handle 23 and, as FIGS. 5 and 6 show, an angular abutment 24 is formed on blade 16 where the handle 23 is formed upwardly.

Sheath 12, which is fabricated of rigid material such as plastic or the like, comprises a pair of spaced apart side walls 26 and 28 and a pair of spaced apart edge walls 30 and 32, all of which walls cooperate to define an elongated blade-receiving passage 34 which has an opening 35 at one end and, preferably, is closed at the other end 36 of the sheath. Passage 34 has a longitudinal axis X extending lengthwise of sheath 12, as FIG. 1 shows, and gradually narrows when proceeding in a direction away from opening 35 to closed end 36 so as to more closely conform to the general taper of the closed blades 14 and 16 of scissors 10. Sheath 12 includes a slot 40 extending inwardly from edge 30, as hereinafter explained, in which a sharpening element 42 is disposed.

As FIGS. 2, 3, 4, 5, 6, 8 and 9 show, the sheath 12 comprises a pair of molded plastic components 50 and 52 which are substantially mirror images of each other, except as hereinafter explained. Each component 50, 52 comprises an elongated portion 60 and an integral end portion 62. The end portion 62 of each of the components 50, 52 comprises a slot portion 64 extending inwardly from an edge of the component transverse to the longitudinal axis X of the component. Means are provided for securing the pair of components 50, 52 together in side-by-side relationship (FIG. 4) whereby said components define sheath 12 having the blade-receiving slot 40 therein. Such means comprise peripherally arranged integral interlocking flanges 68 and 70 on components 50 and 52, respectively, which are sonic welded together at seam 72 in FIG. 9, but are not welded along the edge region 73 shown in FIG. 8.

Each component 50, 52 has two integrally formed receiving elements 76, one on each side of slot portion 64, formed on the inside surface of its end portion 62 into which the cylindrical ceramic sharpening element 42 is snap-fitted in a friction fit, instead of being sonic welded or glued. The blade sharpening means are thus secured by entrapment between pair of components 50, 52 when the latter are secured together. A portion of element 42 extends across its associated blade-receiving slot portions 64. Each receiving element 76 into which ceramic sharpening element 42 is inserted is confronted by a projection or surface 80 or 82 which defines the ends of a groove 84 for receiving the sharpening element. Axial shifting or displacement of an element 42 is prevented by surfaces 80 and 82.

In accordance with the invention, sheath 12 provided with scissors blade sharpening means mounted thereon which enable both blades 14 and 16 to be sharpened simultaneously. As FIGS. 1, 2, 3, 5, 6 and 7 show, the blade sharpening means generally comprise a blade-receiving sharpening slot, generally designated 40, formed in sheath 12 and a blade sharpening element 42 attached to the sheath and located in passage 34 transverse to the slot 40. The slot 40, which extends inwardly from sheath edge 30 near end opening 35, is defined by or includes two offset slot portions 40A and 40B which are substantially perpendicular to axis X and interconnected by a slanted intermediate slot portion 40C which slopes relative to axis X and on axis Y (FIG. 1). As FIG. 1 shows, the slot 40 has a general axis Y which is transverse to the longitudinal axis X of the sheath 12.

The blade sharpening element 42 is rigidly mounted by entrapment in sheath 12 and is located in passage 34 and in the sharpening slot 40 in a position to make sliding engagement with the cutting edges 20 and 22 of the blades 14 and 16, respectively, being moved in the sharpening slot 40 on opposite sides of abrasive member 42 to effect sharpening thereof, as FIGS. 3 and 4 show. The blade sharpening element 42 is fabricated of abrasive material harder than the material of which the knife blades 14 and 16 are made, such as tool steel, carborundum or ceramic abrasive, which is capable of sharpening the blade edges 20 and 22. Referring to FIGS. 3, 5, 6, 7 and 9, the blade sharpening element 42 preferably takes the form of an elongated cylindrical rigid abrasive ceramic element which is mounted in passage 34 on sheath 12 by being entrapped and secured in a depression 84 defined by integrally formed projections, hereinafter described, molded in the components forming sheath 12. As FIG. 1 shows, element 42 defines an acute angle with sheath axis X and lies within the slot 40 so that when the blades 14 and 16 move in the slot, the edges 20 and 22 can make contact with sharpening element 42, as FIG. 3 shows. The slot 40 is formed in such a size as to mechanically support, steady and position the blades 14 and 16 relative to the sharpening element 42 during sharpening. Thus, in FIG. 3 the aligned vertical walls of slot portions 40A and 40B are seen to be positioned to effect such functions. Slot portion 40B is about one-third to one-half longer than the maximum width of a blade 14 so as to be long enough to allow for some tilt of the blade 14 as it moves reciprocably in the slot 40 during sharpening.

In operation, as FIGS. 3 and 4 show, the blades 14 and 16 are inserted through the slot portions 40A and 40B on opposite sides of members 42 and are moved reciprocably therein (see arrow B in FIG. 4) as the blade edges 20 and 22 to be sharpened bear against the blade sharpening means 42 in the slot 40. Such movement continues until the desired degree of sharpness is attained.

Referring now to FIGS. 2, 4, 5, 6, 7 and 8, the means for preventing dislodgment or unintentional removal of the scissors 10 from the sheath 12 are seen to comprise a resilient elongated latch member 90 which is integrally connected at one of its ends to the edge wall 26 defined by the component 52 defining the sheath 12. The other end of the resilient elongated latch member 90 is provided with an abutment or latch projection 92 having a camming ramp 93 and which extends into the passage 34 in the sheath 12. Insertion of the closed scissors blades 14 and 16 through the end opening 35 and into the passage 34 in the sheath causes engagement of the outside edge of blade 14 with the projection 92 on the latch member 90 to bias outwardly to allow blade insertion until the blades are fully inserted, whereupon the latch member returns inwardly and the latch projection 92 engages portion or shoulder 24 of the scissors 10 from the sheath 12 unless sufficient force is exerted to cause displacement of the resilient latch member.

Figure 8:
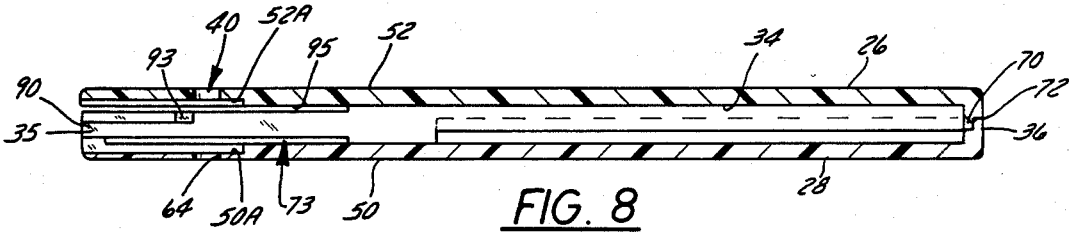
FIG. 8 is a cross-section view of the sheath taken on line 8—8 of FIG. 2.
Figure 9:
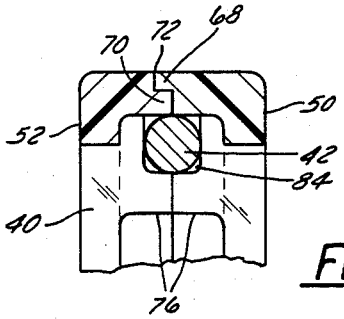
FIG. 9 is an enlarged cross-section view taken on line 9—9 of FIG. 3.

Provision of the latch member 90, which is partially separated from component 52 by a slot 95, and separated from component 50 along the edge region 73 shown in FIG. 8, enables releasable engagement of a pair of scissors inserted in the sheath to positively but releasably secure the scissors in the sheath, and prevents accidental withdrawal of the scissors. Portions of 50 and 52 are relieved at 50A and 52A to accept rivet 18 of the scissors.

We claim:

1. In combination:

a scissors sheath including an elongated passage open at one end for accommodating insertion and withdrawal along a path of travel in said passage of the closed blades of a pair of scissors;

blade sharpening means on said sheath comprising a sharpening slot extending from a side of said sheath transversely into said passage for receiving the scissor blades, said blade sharpening means further comprising a blade sharpening element mounted on said sheath within said slot intermediately of outer and inner slot portions of said slot; and latch means for releaseably securing said pair of scissors in said sheath comprising a resiliently flexible member integrally formed on said sheath within said passage and normally biased into said path of travel but displaceable therefrom for releaseable engagement with a pair of scissors inserted into said sheath.

2. A combination according to claim 1 wherein said resiliently flexible member includes a camming surface against which said pair of scissors bears during withdrawal from said sheath to effect disengagement of said resiliently flexible member from latching engagement with said pair of scissors.

3. In combination:

a scissors sheath including a plurality of molded plastic mating components secured together to provide walls defining an elongated passage open at one end for accommodating insertion and withdrawal along a path of travel in said passage of the closed blades of a pair of scissors;

blade sharpening means on said sheath comprising a sharpening a sharpening slot extending from a wall of said sheath transversely into said passage for receiving the scissor blades, said blade sharpening means further comprising a blade sharpening element mounted on said sheath within said slot intermediately of outer and inner slot portions of said slot by entrapment between at least a pair of said components; and latch means for releaseably securing said pair of scissors in said sheath comprising a resiliently flexible portion of one of said walls integrally connected at one end to said sheath within said passage and normally biased into said path of travel but displaceable therefrom and releaseable engagement with a pair of scissors inserted into said sheath.

4. A combination according to claim 3 wherein said resiliently flexible member includes a camming surface against which said pair of scissors bears during withdrawal from said sheath to effect disengagement of said resiliently flexible member from latching engagement with said pair of scissors.

5. In combination:

a scissors sheath including an elongated passage open at one end for accomodating insertion and withdrawal along a path of travel in said passage of the closed blades of a pair of scissors; and latch means for releasably securing said pair of scissors in said sheath comprising a resiliently flexible member integrally formed on said sheath within said passage and normally biased into said path of travel but displaceable therefrom for releasable engagement with a pair of scissors inserted into said sheath.

6. A combination according to claim 5 wherein said resiliently flexible member includes a camming surface against which said pair of scissors bears during withdrawal from said sheath to effect disengagement of said resiliently flexible member from latching engagement with said pair of scissors.

7. A combination according to claim 6 wherein said sheath comprises a plurality of mating components defining said passage and wherein said flexible member is integrally formed on one of said mating components.

* * * * *